US007815496B2

(12) United States Patent
Lim et al.

(10) Patent No.: US 7,815,496 B2
(45) Date of Patent: Oct. 19, 2010

(54) POLISHING PAD OF A CHEMICAL MECHANICAL POLISHING APPARATUS AND METHOD OF MANUFACTURING THE SAME

(75) Inventors: Young-Sam Lim, Gyeonggi-do (KR); Young-Nam Kim, Gyeonggi-do (KR); Gi-Jung Kim, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 906 days.

(21) Appl. No.: 11/706,241

(22) Filed: Feb. 15, 2007

(65) Prior Publication Data

US 2007/0197143 A1 Aug. 23, 2007

(30) Foreign Application Priority Data

Feb. 17, 2006 (KR) ..... 10-2006-0015386

(51) Int. Cl.
*B24D 11/00* (2006.01)

(52) U.S. Cl. ..... 451/534; 451/526; 451/527; 451/529; 51/293; 51/298

(58) Field of Classification Search ..... 451/526, 451/527, 529, 530, 531, 533, 534; 51/293, 51/298, 299
See application file for complete search history.

(56) References Cited

U.S. PATENT DOCUMENTS 6,585,574 B1 * 7/2003 Lombardo et al. ..... 451/285
2002/0115734 A1 * 8/2002 Obeng et al. ..... 521/53
2004/0023597 A1 * 2/2004 Truong ..... 451/41
2004/0259484 A1 * 12/2004 Prasad et al. ..... 451/287
2005/0197050 A1 * 9/2005 Prasad et al. ..... 451/41
2005/0211376 A1 * 9/2005 Prasad ..... 156/345.12
2005/0215179 A1 * 9/2005 Prasad ..... 451/8
2005/0276967 A1 * 12/2005 Prasad ..... 428/314.8
2005/0282390 A1 * 12/2005 Bian et al. ..... 438/692

FOREIGN PATENT DOCUMENTS

| | | |
|---|---|---|
| JP | 2005-183711 | 7/2005 |
| KR | 0341850 | 6/2002 |
| KR | 102004000867 A | 1/2004 |
| WO | WO 2005/099962 A1 | 10/2005 |

* cited by examiner

*Primary Examiner*—Eileen P. Morgan
(74) *Attorney, Agent, or Firm*—Volentine & Whitt, PLLC

(57) ABSTRACT

The surface(s) of a polishing pad for polishing an object has a first portion including hydrophilic material and a second portion including hydrophobic material. The first portion of the polishing surface is located in a first region of the polishing pad and the second portion of the polishing surface is located in a second region of the polishing pad juxtaposed with the first region in the radial direction of the pad. The hydrophilic material may be a polymer resin that contains hydrophilic functional groups having OH and/or =O at bonding sites of the polymer. The hydrophobic material may be a polymer resin that contains hydrophobic functional groups having H and/or F at bonding sites of the polymer. The polishing pad is manufactured by extruding respective lines of the hydrophilic and hydrophobic materials. The extruders and a backing are moved relative to each other such that the lines form concentric rings of the hydrophilic and hydrophobic materials.

21 Claims, 5 Drawing Sheets

POLISHING PAD OF A CHEMICAL MECHANICAL POLISHING APPARATUS AND METHOD OF MANUFACTURING THE SAME

BACKGROUND OF THE INVENTION

1. Field of the Invention

The present invention relates to a polishing pad of a chemical mechanical polishing (CMP) apparatus and to a method of manufacturing the same.

2. Description of the Related Art

In a typical polishing process performed by a chemical mechanical polishing (CMP) apparatus, a surface of an object is polished by pressing the surface of the object against a rapidly rotating polishing pad and providing slurry between the polishing pad and the surface of the object. The slurry includes an abrasive such as silica ($SiO_2$) or ceria ($CeO_2$), and chemical additives such as surfactants. Therefore, the entire surface of the object is polished by friction created between the abrasive and the surface of the object as well as by a chemical reaction that occurs between the slurry and the object.

In the manufacturing of semiconductor devices and the like, CMP is often used to polish a substrate on which a fine pattern has been formed by a photolithographic process. In particular, the CMP process is used to create a level surface after the fine pattern has been formed and has thereby created steps at the surface of the substrate. However, the CMP process may seriously affect the fine pattern if the process is not controlled precisely. This problem is of great concern in the manufacturing of highly integrated semiconductor devices.

In particular, the pressure between the polishing pad and the substrate is typically adjusted during the CMP process to ensure that the surface of the substrate is polished uniformly. However, in a conventional CMP process, the pressure between the polishing pad and the substrate may depend on the surface of the object being polished. Therefore, the technique of controlling the pressure between the polishing pad and the substrate is difficult to use in a manufacturing process in which CMP is used to polish various surfaces, such as that of a bare substrate, a metal layer, an oxide layer, a nitride layer, and an oxynitride layer, etc. Thus, the polishing pad of a current CMP apparatus has a plurality of grooves in front and rear surfaces thereof in an attempt to ensure that surfaces of the objects, e.g., surfaces on the semiconductor substrates, are all polished uniformly.

FIG. 1 illustrates such a conventional polishing pad of a CMP apparatus. Referring to FIG. 1, the conventional polishing pad 3 is disposed on an upper portion of a plate 1. The polishing pad 3 has grooves 5 and 7 in front and rear surfaces thereof, respectively. The grooves 5 and 7 may improve the uniformity at which surfaces of an object are polished using the polishing pad 3 as compared to a corresponding polishing pad without the grooves. However, the grooves 5 and 7 still can not ensure that all of the different surfaces will be polished uniformly. Additionally, the grooves 5 and 7 reduce the useful life of the polishing pad 3 because the portions of the polishing pad provided with the grooves 5 and 7 are prone to being damaged during the polishing process.

FIG. 3 is a graph of ideal rates at which a central portion and edge portions (representing the periphery) of a surface of an object should be polished using the polishing pad shown in FIG. 1. The graph applies to various surfaces that might be polished such as the surface of a bare semiconductor substrate, an oxide layer, a nitride layer, an oxynitride layer, a metal layer or a metal oxide layer. In FIG. 3, reference character A denotes a tolerable difference between the ideal rate at which the central portion of the object should be polished and the ideal rate at which the edge portions of the object should be polished. That is, as shown in FIG. 3, the central portion of the object may be ideally polished at a rate substantially the same as or slightly higher than the rate at which the edge portions of the object are polished.

FIG. 4 is a graph illustrating actual rates at which various regions of a metal layer on a substrate are polished using the polishing pad shown in FIG. 1. Referring to FIG. 4, the central portion of the object is polished at a rate substantially higher than the rate at which the edge portions of the object are polished. That is, the central portion of the metal layer is removed faster than the edge portions of the metal layer in a CMP process carried out using the CMP apparatus shown in FIG. 1.

FIG. 5 is a graph illustrating actual rates at which various regions of an oxide layer on a substrate polished using the polishing pad shown in FIG. 1. As shown in FIG. 5, the rate at which the edge portions of the oxide layer are polished is substantially greater than the rate at which the central portion of the oxide layer is polished. That is, the edge portions of the oxide layer are removed faster than the central portion of the oxide layer in a CMP process performed using the CMP apparatus shown in FIG. 1.

FIGS. 2A to 2C illustrate a method of manufacturing the conventional polishing pad of a CMP apparatus.

Referring to FIG. 2A, the material of the pad is extruded into a mold 9 by an extruder 11, and the extruded material is hardened in the mold 9. The hardened material is extracted from the mold as an intermediate product having the form of a disc 13 as shown in FIG. 2B. Then, the disc structure 13 is sliced to produce several polishing pads 13*a*, 13*b* and 13*c* as shown in FIG. 2C. Therefore, the polishing characteristics of the polishing pads 13*a*, 13*b* and 13*c* are all the same. That is, the polishing pads 13*a*, 13*b* and 13*c* can not be used in a manufacturing process in which different types of surfaces, such as that of a bare substrate, an oxide layer, a metal layer, a nitride layer and/or an oxynitride layer, must all be polished uniformly by CMP.

SUMMARY OF THE INVENTION

An object of the present invention is to provide a polishing pad which can polish an object uniformly when the pad is used in a CMP apparatus.

Another object of the present invention is to provide a polishing pad tailored to a particular type of material whose surface is to be polished by the pad in a CMP process.

Another object of the present invention is to provide a method of by which such polishing pads can be easily manufactured.

According to one aspect of the present invention, there is provided a polishing pad whose polishing surface(s) has a first portion including hydrophilic material and a second portion including hydrophobic material. The first portion of the polishing surface is located in a first region of the polishing pad and the second portion of the polishing surface may located in a second region of the polishing pad juxtaposed with the first region in the radial direction of the pad.

The hydrophilic material may be a polymer resin that includes hydrophilic functional groups having OH and/or =O at bonding sites of the polymer. For example, the hydrophilic material may be polyethylene glycol (PEG), polyvinyl alcohol (PVA), polyvinyl acetate (PVAC), unsaturated polyester resin, polyurethane, or a mixture of at least two of these materials. The hydrophobic material may be a polymer resin that includes hydrophobic functional groups having H and/or F at bonding sites of the polymer. For example, the hydrophobic material may be polycarbonate, polyethylene terephthalate glycol, polypropylene, diallylglycol carbonate, polyurethane, polybutadiene or a mixture of at least two of these materials.

The first portion of the polishing surface may be located in a peripheral region of the polishing pad and the second portion of the polishing surface may be located in central region of the polishing pad. In this case, the density of the hydrophilic material of the first portion of the polishing surface is higher at one region thereof closer to the center of the polishing pad than at another region thereof closer to the periphery of the polishing pad. On the other hand, the density of the hydrophobic material of the second portion of the polishing surface is higher at one region thereof closer to the periphery of the pad than at another region thereof closer to the center of the polishing pad. This embodiment is particularly useful in polishing a metal layer on a substrate.

Alternatively, the first portion of the polishing surface is located in a central region of the polishing pad and the second portion of the polishing surface is located in a peripheral region of the polishing pad. In this case, the density of the hydrophobic material of the second portion of the polishing surface is higher at a one region thereof located closer to the center of the polishing pad than at another region thereof located closer to the periphery of the polishing pad. On the other hand, the density of the hydrophilic material of the first portion of the polishing surface is higher at one region thereof closer to the periphery of the polishing pad than at another region thereof located closer to the center of the polishing pad. This embodiment is particularly useful in polishing an insulation layer, such as an oxide layer, on a substrate.

Also, the polishing surface may comprise concavities and convexities. Specifically, the polishing surface may have a plurality of grooves or recesses laid in the pattern of a series of concentric circles or a spiral originating at the center of the pad.

According to another aspect of the present invention, there is provided a method of manufacturing a polishing pad including extruding hydrophilic material and hydrophobic material onto a backing. The hydrophilic and hydrophobic materials may be extruded into concentric rings. Also, the hydrophilic and hydrophobic materials may be cured by being baked, i.e., by being thermally treated. Subsequently, the polishing surface(s) may be cut to form concavities (grooves or recesses) in the polishing surface.

BRIEF DESCRIPTION OF THE DRAWINGS

The above and other objects, features and advantages of the present invention will become more apparent from the following detailed description of the preferred embodiments thereof made with reference to the accompanying drawings, in which.

DETAILED DESCRIPTION OF THE PREFERRED EMBODIMENTS

Figure 1:
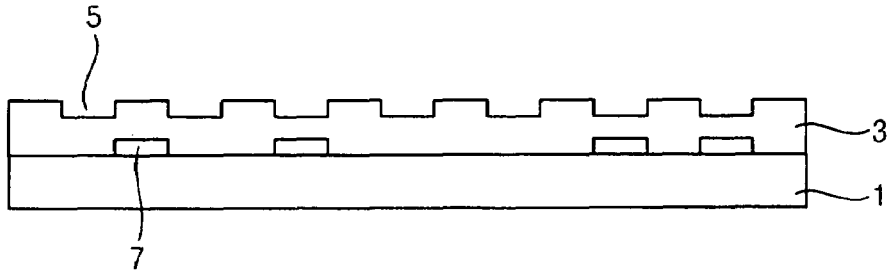
FIG.1 (PRIOR ART)
FIG. 1 is cross-sectional view of a conventional polishing pad and platen of a CMP apparatus.
Figure 2A:
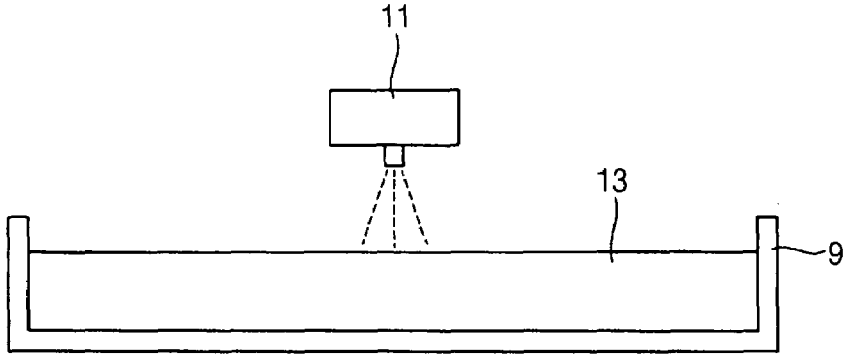
FIG.2A (PRIOR ART)
FIG. 2A is a schematic diagram of an apparatus for use in manufacturing conventional polishing pads.
Figure 2B:
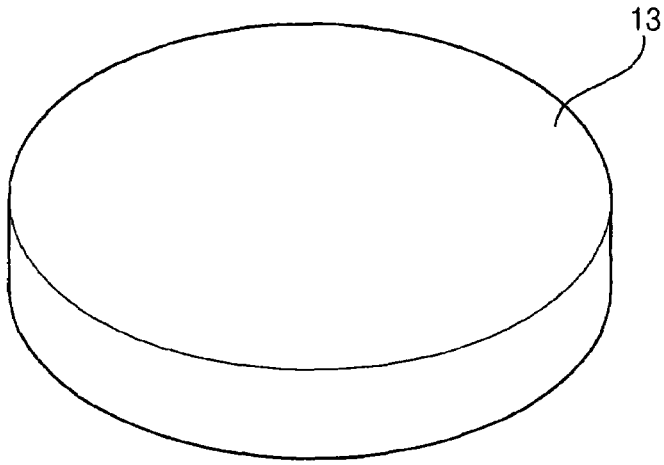
FIG.2B (PRIOR ART)
FIG. 2B is a perspective view of a product made using the apparatus of FIG. 2A and from which product conventional polishing pads are made.
Figure 2C:
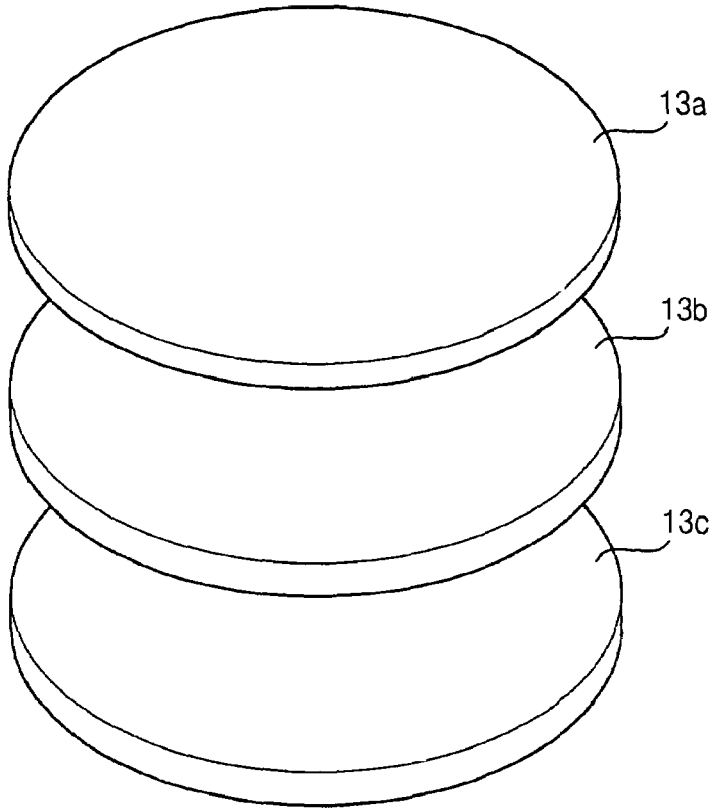
FIG.2C (PRIOR ART)
FIG. 2C is a perspective view of conventional polishing pads produced form the product shown in FIG. 2B.
Figure 3:
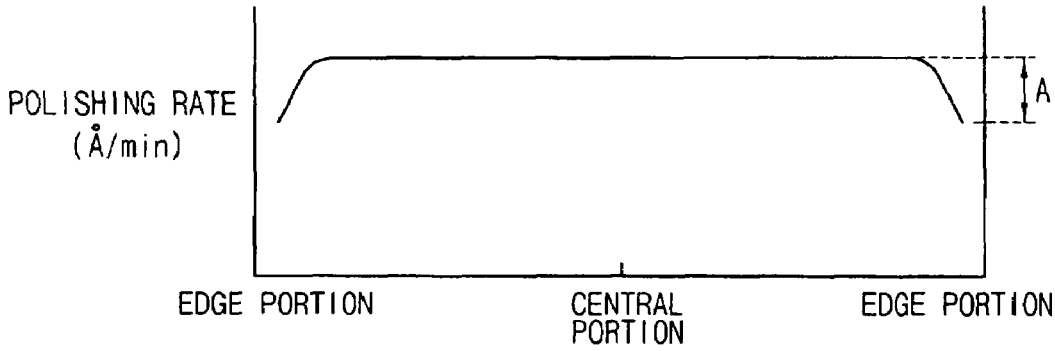
FIG.3 (PRIOR ART)
FIG. 3 is a graph illustrating ideal rates at which various regions of an object should be polished using the polishing pad shown in FIG. 1.

The present invention will be described more fully hereinafter with reference to FIGS. 6-9. In the drawings, the sizes, shapes and relative sizes of various features may be exaggerated for clarity. In particular, the drawings are schematic illustrations. As such, the actual shapes of certain features may vary from those illustrated due to manufacturing techniques and/or tolerances, for example. Thus, the present invention should not be construed as limited to the particular shapes, sizes and relative sizes shown in the drawings unless otherwise specifically noted herein.

Figure 6:
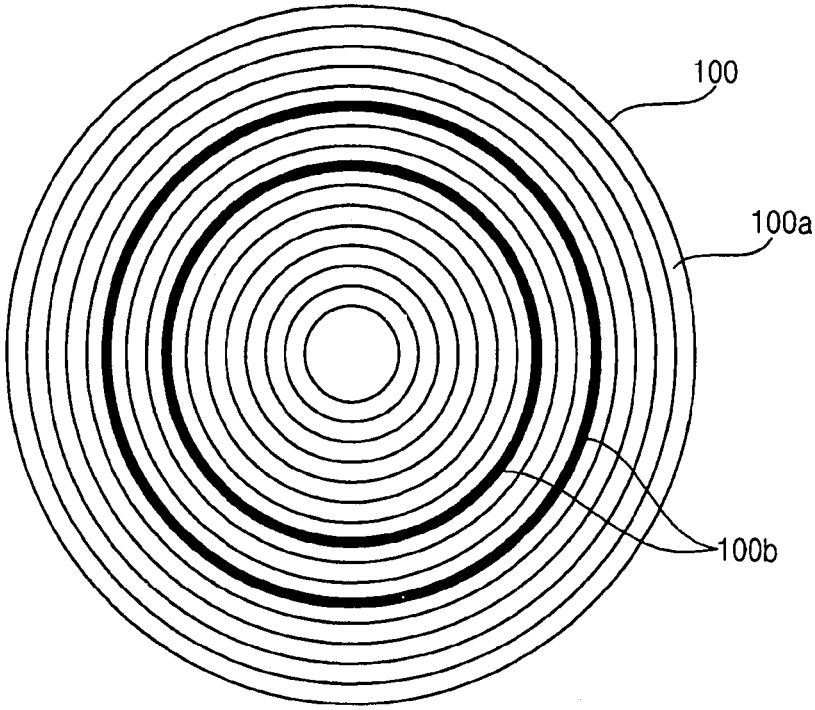
FIG. 6 is a plan view of an embodiment of a polishing pad for use in a CMP apparatus according to the present invention.

FIG. 6 illustrates a first embodiment of a polishing pad 100 according to the present invention, which is particularly useful in a CMP process for polishing a metal layer on a substrate. At least one surface of the polishing pad 100, namely the polishing surface, has a first portion 100*a* and a second portion 100*b*. The first and second surface portions 100*a* and 100*b* are located in regions juxtaposed in the radial direction of the pad. Also, each of the first and second surface portions 100*a* and 100*b* may be made up of one or more circular surface regions, and the circular surface regions making up the first and second surface portions 100*a* and 100*b* are concentric.

The first surface portion 100*a* is constituted by a hydrophilic material, whereas the second surface portion 100*b* is constituted by a hydrophobic material. In the embodiment shown in FIG. 6, the first surface portion 100*a* constitutes an outer peripheral region of the surface of the pad. The second surface portion 100*b* constitutes a central region of the surface of the pad, i.e., a region that is located closer to the center of the pad than the first surface portion 100*a*. In this embodiment, the density of the hydrophilic material constituting the first surface portion 100*a* may decrease in a radial direction from the central region of the polishing pad 100 to the peripheral region of the polishing pad 100. On the other hand, the density of the hydrophobic material constituting the second surface portion 100*b* may increase in a radial direction from the central region of the polishing pad 100 to the peripheral region of the polishing pad 100, e.g., the inner ring of hydrophobic material may be of a higher density than the outer ring of hydrophobic material in the embodiment of FIG. 6.

The hydrophilic material constituting the first portion 100*a* of the surface of the polishing pad 100 may include a polymer resin that has hydrophilic functional groups containing OH and/or =O at bonding sites of the polymer chain. Examples of the hydrophilic material are polyethylene glycol (PEG), polyvinyl alcohol (PVA), polyvinyl acetate (PVAC), unsaturated polyester resin, and polyurethane. Each region of the polishing pad 100 constituting the first portion 100*a* may consist of one of these hydrophilic materials or a mixture of respective ones of these materials. In the case of polyurethane, the polyurethane may be composed specifically so as to be hydrophilic.

The hydrophobic material constituting the second portion 100*b* of the surface of the polishing pad 100 may include a polymer resin that has hydrophobic functional groups containing H and/or F at bonding sites of the polymer chain. Examples of the hydrophilic material are polycarbonate, polyethylene terephthalate glycol, polypropylene, diallylglycol carbonate, polyurethane, and polybutadiene. Each region of the polishing pad 100 constituting the second portion 100*b* may consist of one of these hydrophobic materials or a mixture of respective ones of these materials. In the case of polyurethane, the polyurethane may be composed specifically so as to be hydrophobic.

Figure 4:
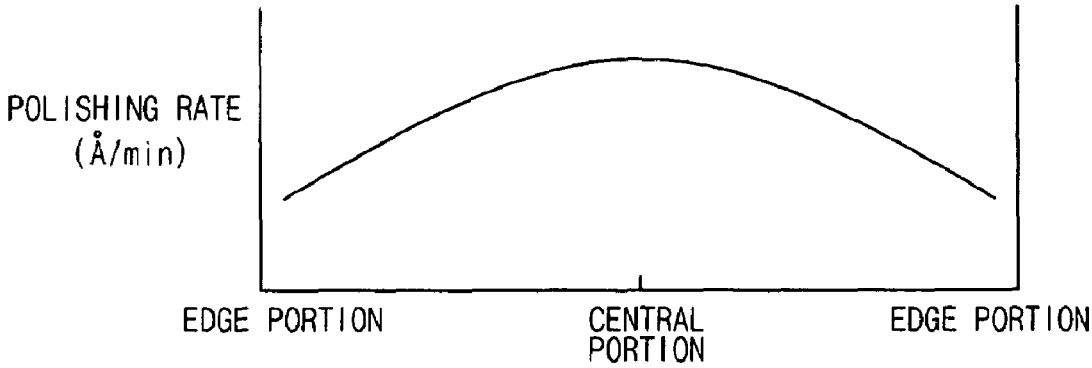
FIG.4 (PRIOR ART)
FIG. 4 is a graph illustrating actual rates at which various regions of a metal layer on a substrate are polished using the polishing pad shown in FIG. 1.

When a CMP process is carried out using the polishing pad 100, the amount of a slurry which accumulates per unit area of the first surface portion 100*a* will be substantially larger than the amount of the slurry which accumulates per unit area of the second surface portion 100*b* because the slurry has a greater affinity for the hydrophilic material than the hydrophobic material. Accordingly, in a CMP process for polishing a metal layer using the CMP apparatus having the polishing pad 100, the rate at which the edge (peripheral) portion of the metal layer is polished will be substantially the same as the rate at which the central portion of the metal layer will be polished because a substantially greater amount of slurry will be dispersed over the first surface pad 100*a* than over the second surface portion 100*b* of the polishing pad 100. That is, the metal layer will be uniformly polished unlike the results shown in FIG. 4 in which the conventional polishing pad shown in FIG. 1 is used.

Also, the hydrophilic material is relatively weak. That is, the first surface portion 100*a* of hydrophilic material compromises the strength of the polishing pad 100. Thus, the second surface portion 100*b* of the polishing pad 100 may be designed to ensure that the polishing pad 100 is sufficiently strong. In particular, the second surface portion 100*b* of the polishing pad 100 is made wide enough to provide the polishing pad 100 with sufficient mechanical strength. In one embodiment, the polishing pad was sufficiently strong when the total width of the second surface portion 100*b* was about 1 cm or greater.

In addition, the surface of the polishing pad 100 has concavities and convexities so as to enhance the ability of the polishing pad 100 to uniformly polish a surface of an object such as a surface of a metal layer on a substrate. For example, the polishing pad 100 have grooves or recesses extending in the front and rear surfaces thereof. The grooves or recesses may lie along a series of concentric circles or along a spiral originating at the center of the pad.

Figure 7:
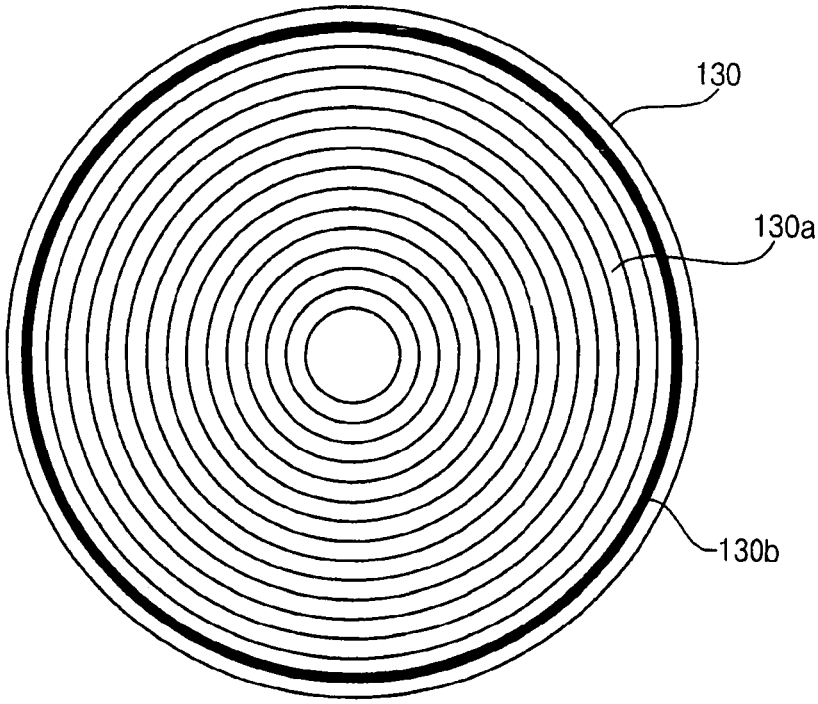
FIG. 7 is a plan view of a second embodiment of a polishing pad for use in a CMP apparatus according to the present invention.

FIG. 7 illustrates a second embodiment of a polishing pad 130 according to the present invention, which is particularly useful in a CMP process for polishing an insulation layer such as an oxide layer. At least one surface of the polishing pad 130, namely the polishing surface, has a first portion 130*a* and a second portion 130*b*. The first and second surface portions 130*a* and 130*b* are located in regions juxtaposed in the radial direction of the pad. Also, each of the first and second surface portions 130*a* and 130*b* may be made up of one or more circular surface regions, and the circular surface regions making up the first and second surface portions 130*a* and 130*b* are concentric.

The first surface portion 130*a* is constituted by a hydrophilic material, whereas the second surface portion 130*b* is constituted by a hydrophobic material. In the embodiment shown in FIG. 7, the first surface portion 130*a* constitutes a central region of the surface of the pad. The second surface portion 130*b* constitutes a peripheral region of the surface of the pad, i.e., a region that is located further away from the center of the pad than the first surface portion 130*a*. For example, the first surface portion 130*a* of hydrophilic material may constitute a circular central region of the polishing pad 130, and the second surface portion 130*b* of hydrophobic material may constitute a single annular peripheral region of the polishing pad 130. In this embodiment, the density of the hydrophilic material constituting the first surface portion 130*a* may increase in a radial direction from the central region of the polishing pad 130 to the peripheral region of the polishing pad 130. On the other hand, the density of the hydrophobic material constituting the second surface portion 130*b* may decrease in a radial direction from the central region of the polishing pad 130 to the peripheral region of the polishing pad 130.

The hydrophilic material constituting the first portion 130*a* of the surface of the polishing pad 130 may include a polymer resin that has hydrophilic functional groups containing OH and/or =O at bonding sites of the polymer chain. Examples of the hydrophilic material are polyethylene glycol (PEG), polyvinyl alcohol (PVA), polyvinyl acetate (PVAC), unsaturated polyester resin, and polyurethane. Each region of the polishing pad 130 constituting the first portion 130*a* may consist of one of these hydrophilic materials or a mixture of respective ones of these materials.

The hydrophobic material constituting the second portion 130*b* of the surface of the polishing pad 130 may include a polymer resin that has hydrophobic functional groups containing H and/or F at bonding sites of the polymer chain. Examples of the hydrophilic material are polycarbonate, polyethylene terephthalate glycol, polypropylene, diallylglycol carbonate, polyurethane, and polybutadiene. The hydrophobic material constituting the second portion 100*b* of the surface of the polishing pad 100 may include a polymer resin that has hydrophobic functional groups containing H and/or F at bonding sites of the polymer chain. Examples of the hydrophilic material are polycarbonate, polyethylene terephthalate glycol, polypropylene, diallylglycol carbonate, polyurethane, and polybutadiene. Each region of the polishing pad 130 constituting the second portion 130*b* may consist of one of these hydrophobic materials or a mixture of respective ones of these materials.

Figure 5:
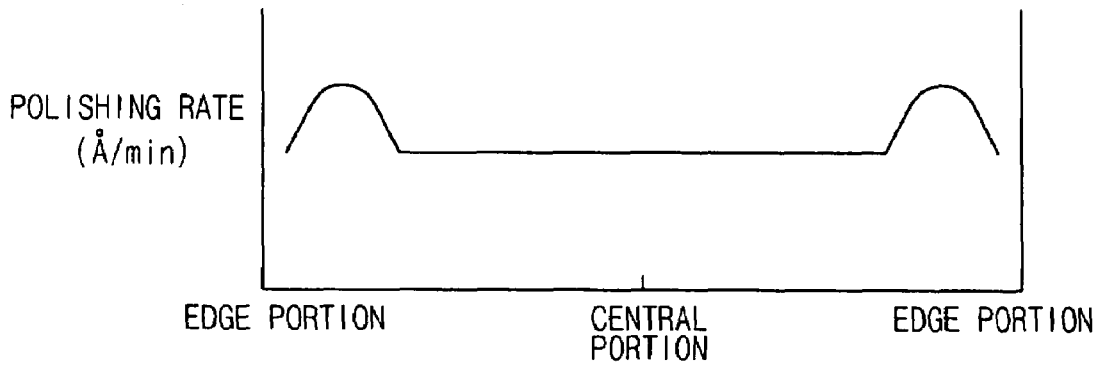
FIG. 5 is a graph illustrating actual rates at which various regions of an oxide layer on a substrate are polished using the polishing pad shown in FIG. 1.
Figure 8:
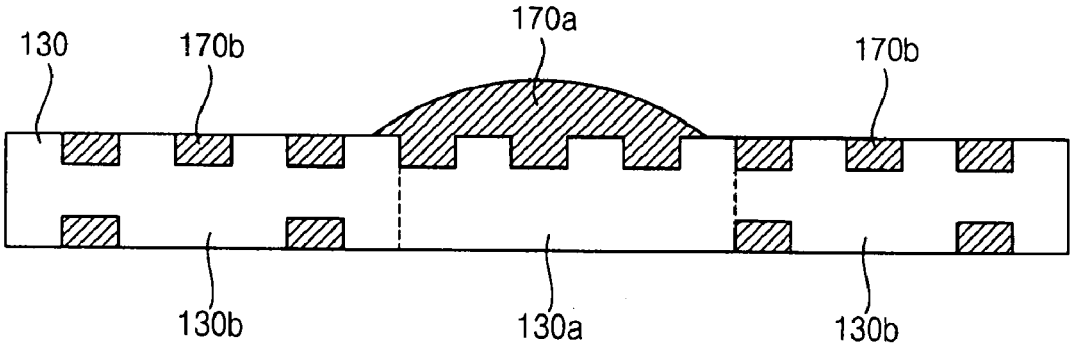
FIG. 8 is a cross-sectional view of the second embodiment of a polishing pad according to the present invention, illustrating the distribution of slurry on the polishing pad during a CMP process.

When a CMP process is carried out using the polishing pad 130, the amount of a slurry 170*a* which accumulates per unit area of the first surface portion 130*a* will be substantially larger than the amount of the slurry 170*b* which accumulates per unit area of the second surface portion 130*b*, as shown in FIG. 8, because the slurry has a greater affinity for the hydrophilic material than the hydrophobic material. Accordingly, in a CMP process for polishing an oxide layer using the CMP apparatus having the polishing pad 130, the rate at which the edge (peripheral) portion of an insulating layer (e.g., an oxide layer) is polished will be substantially the same as the rate at which the central portion of the insulating layer (e.g., the oxide layer) will be polished because a substantially greater amount of slurry will be dispersed over the first surface pad 130*a* than over the second surface portion 130*b* of the polishing pad 100. That is, the insulating layer will be uniformly polished unlike the results shown in FIG. 5 in which the conventional polishing pad shown in FIG. 1 is used.

In addition, the surface of the polishing pad 130 has concavities and convexities so as to enhance the ability of the polishing pad 130 to uniformly polish a surface of an object such as a surface of a metal layer on a substrate. For example, the polishing pad 130 have grooves or recesses extending in the front and rear surfaces thereof. The grooves or recesses may lie along a series of concentric circles or along a spiral originating at the center of the pad.

Figure 9:
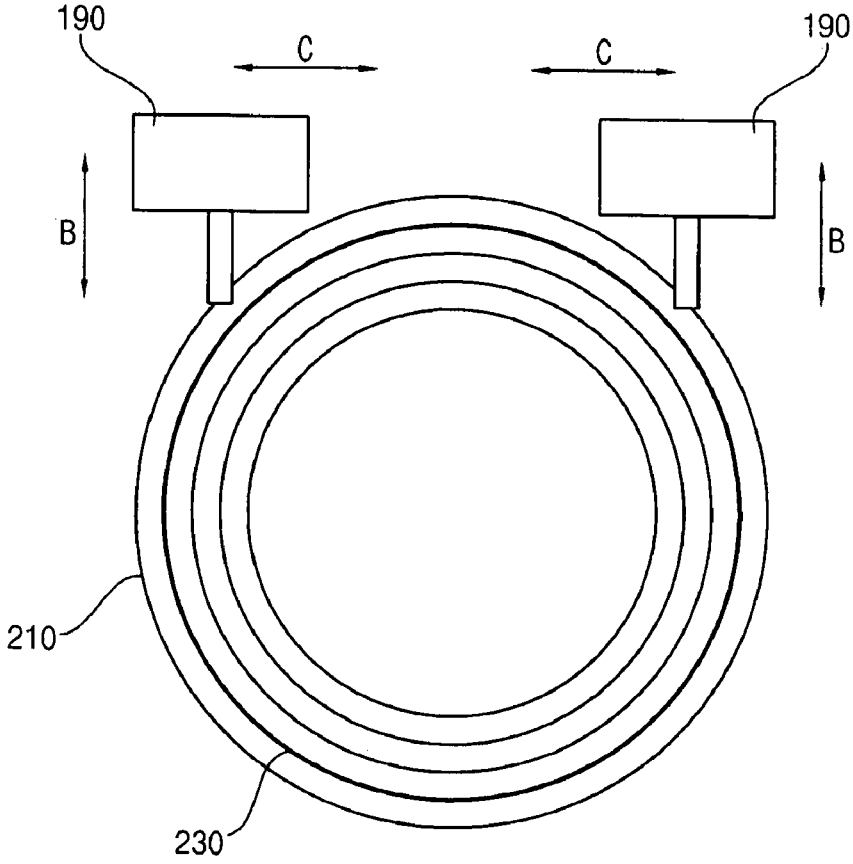
FIG. 9 is an explanatory diagram illustrating a method of manufacturing a polishing pad according to the present invention.

A method of manufacturing a polishing pad according to the present invention will now be described in detail. Referring to FIG. 9, apparatus for manufacturing a polishing pad according to the present invention has at least two extruders 190. At least one of the extruders 190 is operative to extrude a hydrophilic material, and at least one of the other extruders 190 is operative to extrude a hydrophobic material. The hydrophilic material may include a polymer resin that has hydrophilic functional groups containing OH and/or ═O at bonding sites of the polymer chain. For example, the hydrophilic material may be PEG, PVA, PVAC, unsaturated polyester resin, polyurethane, or a mixture of two or more of these materials. The hydrophobic material may be a polymer resin that has hydrophobic functional groups containing H and/or F at bonding sites of the polymer chain. For example, the hydrophilic material may be polycarbonate, polyethylene terephthalate glycol, polypropylene, diallylglycol carbonate, polyurethane, polybutadiene, or a mixture of two or more of these materials.

The extruders 190 are selectively operated to respectively extrude the hydrophilic material and the hydrophobic material over first and second areas of a backing, respectively. The backing may already have some other portion of the polishing pad disposed thereon. Also, the nozzle of each extruder 190 extrudes a line (bead) of material having a width of about 1 cm. The extruders 190 and backing are moved relative to each other such that the lines form concentric rings of the hydrophilic and hydrophobic materials. For example, the extruders 190 are each moved in orthogonal directions B and C (i.e., in a horizontal plane) such that circular lines of the hydrophilic and hydrophobic materials are formed on the backing. The extruders 190 are also free to move up and down. The extrusion processes are repeatedly and selectively carried out according to design parameters of the polishing pad, i.e., to form a pad which is useful in polishing the surface of a particular material in a CMP process (such as either of the pads described above in connection with FIGS. 6 and 7). Also, at this time the composition of the material fed to the extruders and/or the amount of air in the material may be adjusted to vary the density of the material being extruded.

The hydrophilic material and the hydrophobic material extruded from the extruders 190 is then hardened by subjecting the material to a curing process. The curing process may be a thermal treatment process in which the materials are baked. The resultant structure can be removed from the backing once the materials are sufficiently hard. As a result, a polishing pad is formed in which a major surface thereof has a first portion 210 of hydrophilic material and a second portion 230 of hydrophobic material.

In addition, the surface of the polishing pad may be subsequently cut to form concavities therein. That is, a plurality of grooves or recesses may be formed in the surface of the polishing pad.

According to the present invention as described above, a polishing surface of a polishing pad has a first portion including hydrophilic material and a second portion including hydrophobic material. The first and second portions are laid out according to the type of layer such as a metal layer, an insulation layer or a bare substrate that the pad will is to polish in a CMP process. Thus, the layer will be uniformly polished. When the polishing pad is employed in a CMP process for manufacturing a semiconductor device, a level surface will be produced and/or any fine pattern disposed under the layer being polished will not be damaged. Thus, the present invention facilitates the production of reliable semiconductor devices and of semiconductor devices having superior electrical characteristics. Also, as described above, the present invention provides a method by which such a polishing pad may be easily manufactured.

Finally, although the present invention has been described in connection with the preferred embodiments thereof, it is to be understood that the scope of the present invention is not so limited. On the contrary, various modifications of and changes to the preferred embodiments will be apparent to those of ordinary skill in the art. Thus, changes to and modifications of the preferred embodiments may fall within the true spirit and scope of the invention as defined by the appended claims.

What is claimed is:

1. A polishing pad for polishing an object, the polishing pad having opposite major surfaces, at least one of the major surfaces being a polishing surface, and the polishing surface having a first portion including hydrophilic material, and a second portion including hydrophobic material, wherein the density of one of the hydrophilic material and the hydrophobic material increases in a radial direction from a central region to a peripheral region of the polishing pad, and the density of the other of the hydrophilic material and the hydrophobic material decreases in said radial direction.

2. The polishing pad of claim 1, wherein the first and second portions of the polishing surface are located in respective regions of the pad that are juxtaposed in a radial direction of the pad.

3. The polishing pad of claim 2, wherein the first portion of the polishing surface is located in a peripheral region of the polishing pad and the second portion of the polishing surface is located in central region of the polishing pad.

4. The polishing pad of claim 2, wherein the first portion of the polishing surface is located in a central region of the polishing pad and the second portion of the polishing surface is located in a peripheral region of the polishing pad.

5. The polishing pad of claim 1, wherein the hydrophilic material comprises a polymer resin that includes hydrophilic functional groups having OH and/or ═O at bonding sites of the polymer.

6. The polishing pad of claim 5, wherein the hydrophilic material comprises at least one material selected from the group consisting of polyethylene glycol (PEG), polyvinyl alcohol (PVA), polyvinyl acetate (PVAC), unsaturated polyester resin and polyurethane.

7. The polishing pad of claim 1, wherein the hydrophobic material comprises a polymer resin that includes hydrophobic functional groups having H and/or F at bonding sites of the polymer.

8. The polishing pad of claim 1, wherein the hydrophobic material comprises at least one material selected from the group consisting of polycarbonate, polyethylene terephthalate glycol, polypropylene, diallylglycol carbonate, polyurethane and polybutadiene.

9. The polishing pad of claim 1, wherein the polishing surface comprises concavities and convexities.

10. The polishing pad of claim 1, wherein the density of the hydrophilic material of the first portion of the polishing surface decreases in said radial direction, and the density of the hydrophobic material of the second portion of the polishing surface increases in said radial direction.

11. The polishing pad of claim 10, wherein the first portion of the polishing surface is located in a peripheral region of the polishing pad and the second portion of the polishing surface is located in central region of the polishing pad.

12. The polishing pad of claim 1, wherein the density of the hydrophobic material of the second portion of the polishing surface decreases in said radial direction, and the density of the hydrophilic material of the first portion of the polishing surface increases in said radial direction.

13. The polishing pad of claim 12, wherein the first portion of the polishing surface is located in a central region of the polishing pad and the second portion of the polishing surface is located in a peripheral region of the polishing pad.

14. A method of manufacturing a polishing pad, comprising:

extruding hydrophilic material onto a first area of a backing;

extruding hydrophobic material onto a second area of the backing; and varying the densities of the hydrophilic material and the hydrophobic material being extruded such that the density of one of the hydrophilic material and the hydrophobic material increases in a radial direction from a central region to a peripheral region of the polishing pad under manufacture, and the density of the other of the hydrophilic material and the hydrophobic material decreases in said radial direction.

15. The method of claim 14, wherein the extruding of hydrophilic material comprises extruding a polymer resin that includes hydrophilic functional groups having OH and/or =O at bonding sites of the polymer.

16. The method of claim 14, wherein the extruding of hydrophobic material comprises extruding a polymer resin that includes hydrophobic functional groups having H and/or F at bonding sites of the polymer.

17. The method of claim 14, further comprising thermally treating the hydrophilic material and the hydrophobic material.

18. The method of claim 14, further comprising cutting concavities into a surface constituted by the hydrophilic material and the hydrophobic material.

19. The method of claim 14, wherein the extruding of the hydrophilic material comprises forming a ring of the hydrophilic material.

20. The method of claim 14, wherein the extruding of the hydrophobic material comprises forming a ring of the hydrophobic material.

21. The method of claim 14, wherein the extruding of the hydrophilic material and hydrophobic materials comprises forming concentric rings of the hydrophilic and hydrophobic materials.

* * * * *